US005398854A

United States Patent [19]

Blanchard

[11] Patent Number: 5,398,854

[45] Date of Patent: Mar. 21, 1995

[54] ADJUSTABLE GARMENT HANGER

[75] Inventor: Russell O. Blanchard, Zeeland, Mich.

[73] Assignee: Batts, Inc., Zeeland, Mich.

[21] Appl. No.: 161,637

[22] Filed: Dec. 3, 1993

[51] Int. Cl.[6] ..... A47G 25/48

[52] U.S. Cl. ..... 223/96; 223/85; 223/93

[58] Field of Search ..... 223/85, 96, 95, 93, 223/91, 90; 211/113; D6/315, 326, 323

[56] References Cited

U.S. PATENT DOCUMENTS

| | | | |
|---|---|---|---|
| 2,725,164 | 11/1955 | Mordkin | 223/96 |
| 2,889,092 | 6/1959 | Gibron | 223/91 |
| 3,268,128 | 8/1966 | Hobi | 223/96 |
| 4,034,903 | 7/1977 | Batts | 223/96 |
| 4,382,531 | 5/1983 | Bisk et al. | 223/96 |
| 4,446,996 | 5/1984 | Garrison | 223/96 |
| 4,746,039 | 5/1988 | Batts et al. | 223/96 |
| 4,826,056 | 5/1989 | Duester et al. | 223/96 |
| 4,884,726 | 12/1989 | Kolton et al. | 223/91 |
| 4,984,721 | 1/1991 | Eiley et al. | 223/91 |

FOREIGN PATENT DOCUMENTS

| | | | |
|---|---|---|---|
| 4028272 | 3/1992 | Germany | 223/91 |

*Primary Examiner*—Clifford D. Crowder
*Assistant Examiner*—Bibhu Mohanty
*Attorney, Agent, or Firm*—Baker & McKenzie

[57] ABSTRACT

An improved plastic, clamp-style garment hanger is provided. The hanger provides two clamps disposed on an I-beam-like crossbar on opposing sides of a hook. The lateral positions of the clamp are adjustable. The spring-clip that biases the garment engaging surfaces of the clamps together also provides frictional engagement between the clamps and the upper ridge of the crossbar. Hooks disposed at either end of the crossbar are suitable for engaging straps and also limit the outward lateral position of the clamps. Steps or stacking ribs disposed adjacent to the hook limit the inward lateral movement of the clamps. The spring bias of the spring-clip against the clamps resists clamp creep under the weight of a heavy garment.

21 Claims, 3 Drawing Sheets

10
12
14
16
20
22
24
26
28
30
32
36
38
40
42
44
46
48
50
52
54
56
60

10
12
14
16
20
22
24
26
28
30
32
48
60
5
6
7

ADJUSTABLE GARMENT HANGER

FIELD OF THE INVENTION

This invention relates generally to garment hangers and more specifically to clamp-type garment hangers. The garment hanger of the present invention includes improved laterally adjustable clamps.

BACKGROUND OF THE INVENTION

Clamp-type garment hangers, that is garment hangers featuring a crossbar with two clamps disposed at opposing ends thereof, are well-known. Further, clamp-type garment hangers with clamps whose position along the crossbar is laterally adjustable are also known. However, the means for adjusting the lateral position of the clamps along the crossbar has been relatively ineffective and the present invention makes a significant contribution to that effect.

The contribution made by the present invention can be best understood after consideration of the prior art. The first garment hangers equipped with laterally adjustable clamps included a wire or metal crossbar with two metal pinch clips disposed around the crossbar. To avoid the possibility of the clips creeping along the crossbar under the weight of the garment, the frictional engagement between the clips and the crossbar was significant, making it difficult for the consumer to adjust the position of the clips along the crossbar. However, if the portion of the clips that engage the crossbar became loose or worn, the clips moved too easily along the crossbar and the garment would not hang properly. Specifically, if a pair of pants is hung from the pant cuffs from a crossbar, it is highly desirable to stretch the cuff tight between the two clips. For the consumer, this position tends to avoid wrinkling of the pants during storage in the closet. For the retailer, this position is essential for an aesthetically appealing display of the garment in the retail setting.

Plastic clamp-type garment hangers are also known. Further, garment hangers comprised of plastic crossbars and plastic clamps with laterally adjustable clamps are also known. However, the currently available laterally adjustable plastic clamps are not convenient to use or aesthetically appealing from a retail standpoint. Some plastic clamps engage the garment and crossbar so tightly that they cannot be moved once they assume the clamping position. Other plastic clamps are too loose and are disposed to creep as discussed above.

Accordingly, there is a need for a plastic clamp-style garment hanger that is aesthetically appealing and therefore useful in the retail setting and further that includes laterally adjustable clamps that are convenient to use but are not disposed to creeping along the crossbar under the weight of heavy garments such as wool slacks.

SUMMARY OF THE INVENTION

The present invention makes a significant contribution to the garment hanger art by providing an improved clamp-style garment hanger with laterally adjustable clamps that are easy to use and easy to adjust. The hanger includes a hook or hang means connected to a middle or central portion of a plastic crossbar. The crossbar includes two ends and an upper ridge that extends forward and rearward. For aesthetic or structural purposes, the crossbar may include a lower ridge and therefore be configured similar to a I-beam. However, the lower ridge is not a necessary element of the present invention.

The hanger also includes two garment clamps, one slidably connected to each side of the crossbar on opposing sides of the hook. The clamps pivotally engage the upper ridge of the crossbar by providing a front and rear jaw, each with a detent disposed at the middle portion of the jaw for engaging the upper ridge of the crossbar. Specifically, the detent disposed at the middle portion of the front jaw engages the portion of the upper ridge that extends forward. The detent disposed at the middle portion of the rear jaw engages the portion of the upper ridge extending rearward.

Each jaw also includes a lower clamping surface and an upper end which serves as a finger or thumb grip for opening and closing the clamp. A U-shaped spring clip biases the lower clamping surfaces of the front and rear jaws together. The clip includes a front leg disposed in a slot extending down the outer surface of the front jaw and a rear leg disposed in a slot extending down a rear surface of the rear jaw. The U-shaped upper end of the clip passes through and is disposed between slots in the upper ends of the front and rear jaws.

The detents disposed in the central portions of the front and rear jaws as well as the upper ridge of the crossbar are disposed below the U-shaped upper end of the U-shaped clip. The clip firmly biases the detents of the jaws against the upper ridge of the crossbar but not so firmly as to preclude lateral adjustment of the clamps with relative ease. In one preferred embodiment, a rounded hook with a relatively smooth outer surface is disposed at either end of the crossbar. The hook comfortably engages the palm of the hand when fingers are used to grasp and pull the clamp laterally outward toward the hook. Further, the clamp may be easily moved laterally inward by grasping the crossbar with one hand disposed on the opposing side of the hook and pushing the clamp toward the hook with the other hand. The force required for lateral adjustment of the clamp is not great, but is sufficient enough so as to preclude clamp creep when a heavy garment is suspended from the two clamps.

Also in the preferred embodiment, the upper ridge includes a means for limiting lateral inward movement of the clamps. Said means may take three principal forms. First, two vertical stacking ribs may be disposed on either side of the hook. The ribs extend outward from each side of the wall of the crossbar disposed below the upper ridge. The middle portion of the jaws where the detents are connected to the jaws engages the vertical ribs to limit the lateral inward movement of the clamps.

A second form of limiting the lateral inward movement of the clamps includes two outward steps in the upper ridge of the crossbar disposed on either side of the hook. The steps extend outward in both the front and rear directions and engage the detents of both the front and rear jaws to preclude further laterally inward movement of the clamp.

A third means for precluding laterally inward movement of the clamps would be to gradually taper the upper ridge outward as the ridge approaches the hook. The frictional engagement between the detents and the ridge would increase due to the bias imposed by the U-shaped clip as the upper ridge widens thereby effectively limiting the inward movement of the clamps.

It is therefore an object of the present invention to provide an improved clamp-style garment hanger with laterally adjustable clamps.

Yet another object of the present invention is to provide an improved clamp-type garment hanger that is aesthetically pleasing as well as easy to use.

BRIEF DESCRIPTION OF THE DRAWINGS

This invention is illustrated more or less diagrammatically in the accompanying drawings, wherein.

Figures 1, 2:
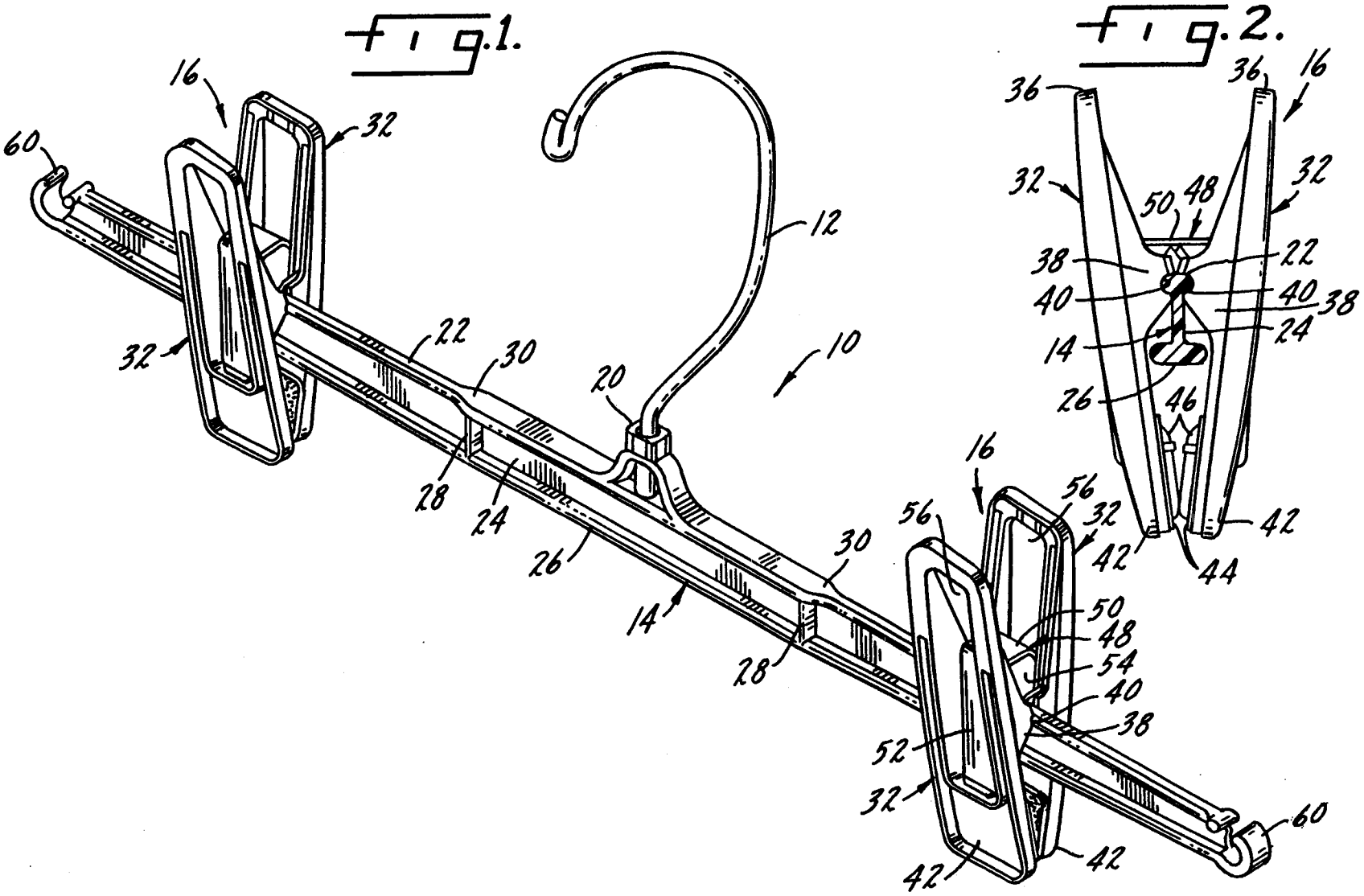
FIG. 1 is a perspective view of a garment hanger made in accordance with the present invention.
FIG. 2 is side elevation of a garment hanger clamp made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, is not necessarily limited to the particular embodiments illustrated herein.

DETAILED DESCRIPTION OF THE INVENTION

Like reference numerals will be used to refer to like or similar parts from Figure to Figure in the following description of the drawings.

Turning to FIG. 1, the garment hanger 10 includes a hook 12 mounted along a central portion of a crossbar 14. Two clamps both indicated at 16 are disposed on opposing sides of the hook 12. The hook 12 is pivotally mounted in a hollow boss indicated at 20. Other means for attaching the hook 12 to the crossbar 14 will be apparent to those skilled in the art. Further, a metallic hook similar to the one shown at 12 in FIG. 1 is not required, the hook may be plastic and may be molded integrally with the crossbar 14 or other hanging means may be provided, such as theft-proof hanging means employed in many hotels.

The crossbar 14 includes an upper ridge 22 disposed on top of a wall 24. A lower ridge 26 is disposed at the lower side of the wall 24. Vertical stacking ribs indicated at 28 are provided for strength as well as a means to preclude laterally inward movement of the clamps 16 inward past the ribs 28 and toward the hook 12. Further, the enlarged portions or steps in the upper ridge shown at 32 preclude further inward lateral movement of the clamps.

Figure 9:
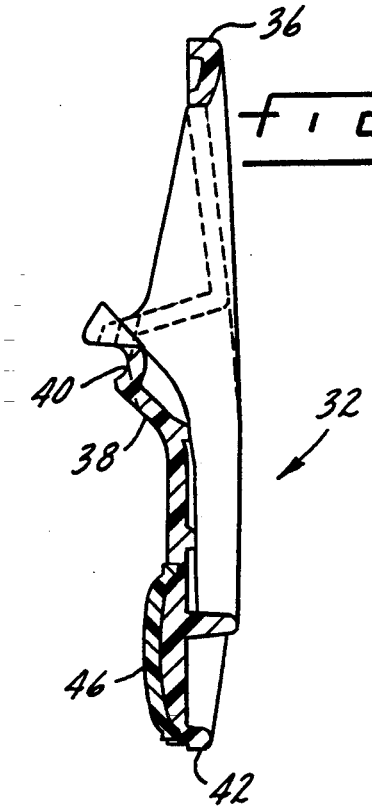
FIG. 9 is a sectional view taken substantially along line 9—9 of FIG. 8.

Turning to FIG. 2, a clamp 16 is illustrated. The clamp 16 includes a front and rear jaws both of which may be identical as in the case of the embodiment shown in FIG. 2. Accordingly, both jaws are indicated at 32. Further, because the front jaw 32 and rear jaw 32 are identical in configuration and all like parts will be similarly numbered. The upper ends 36 may be ergonomically configured to accommodate finger or thumb grips. The central portion 38 includes a C-shaped detent 40 (see FIGS. 9 and 11) that pivotally engages the upper ridge 22 of the crossbar 14. As seen in FIG. 2, the lower ridge 26 of the crossbar 14 does not engage either the front jaw 32 or rear jaw 32 but does add to the structural integrity of the crossbar 14. The lower end 42 of the each jaw 32 includes a garment engaging surface 44. In the embodiment illustrated in FIG. 2, the garment engaging surface 44 accommodate a resilient friction pad 46. The lower ends 42 of the front and rear jaws 32 are spring-biased together by the U-shaped clip 48 of which the U-shaped upper end 50 is partially illustrated in FIG. 2.

Returning to FIG. 1, the U-shaped clip 48 includes an upper end 50, a front leg 52 and rear leg 54. The front leg 52 and rear leg 54 are accommodated in the slots 56 disposed in the front jaw 32 and rear jaw 32 respectively. The front leg 52 and rear leg 54 of the U-shaped clip 48 are spring-biased toward one another and accordingly, spring-bias the lower ends 42 of the jaws 32 toward each other.

Figures 3, 4, 5, 6, 7:
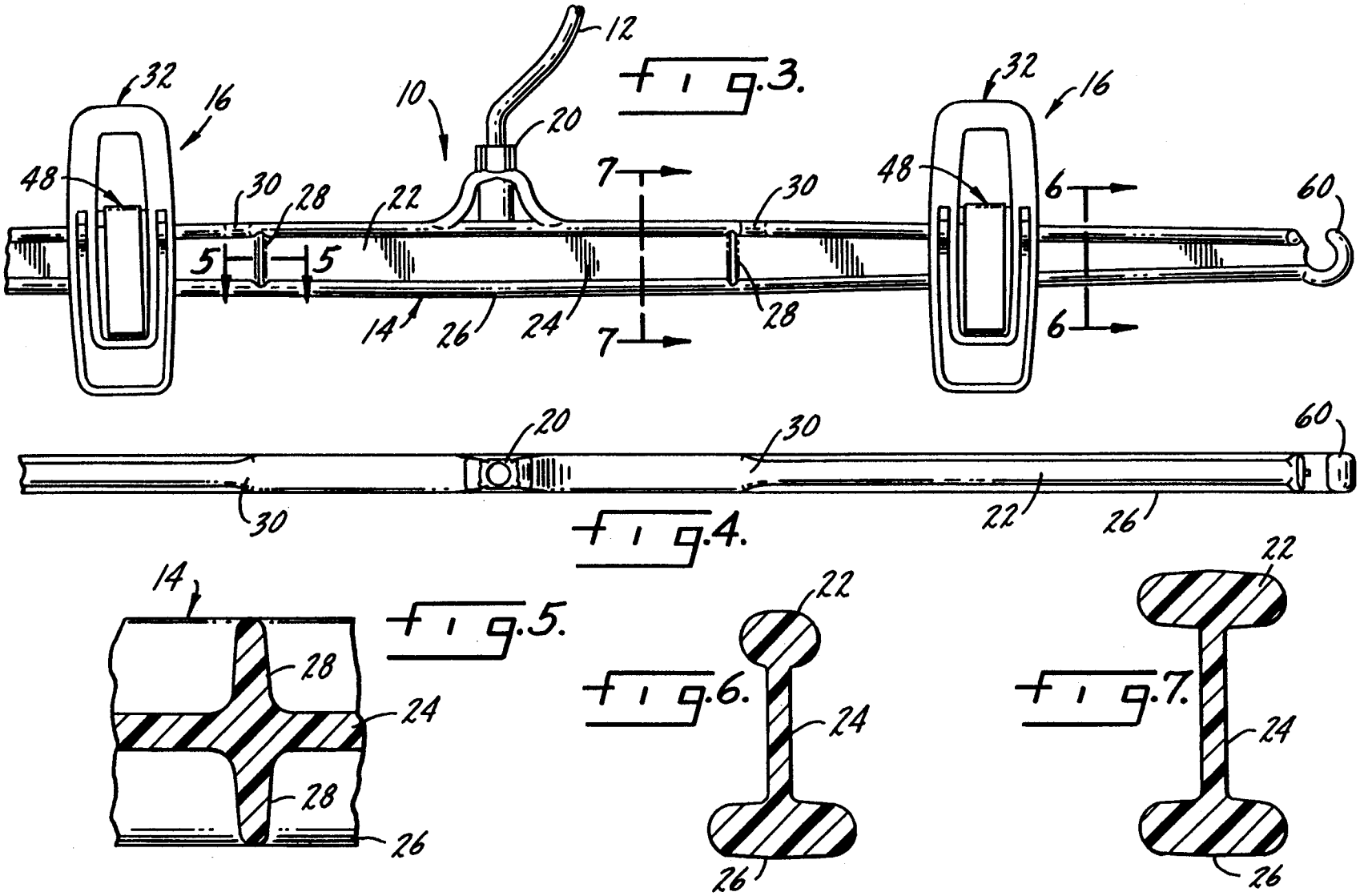
FIG. 3 is a partial front view of the garment hanger shown in FIG. 1.
FIG. 4 is a top view of the crossbar of the garment hanger shown in FIG. 3, the hook being removed.
FIG. 5 is a sectional view taken substantially along line 5—5 of FIG. 3.
FIG. 6 is a sectional view taken substantially along line 6—6 of FIG. 3.
FIG. 7 is a sectional view taken substantially along line 7—7 of FIG. 3.

Turning to FIG. 3, the lateral adjustability of the clamps 16 is illustrated. Either clamp 16 may be moved laterally inward toward the hook 12 until the C-shaped detent 40 (see FIGS. 9 and 11) engages either the step 32 disposed in the upper ridge 22 of the crossbar 14 or until the C-shaped detent 40 engages the rib 28. The hook illustrated at 60 serves at least two purposes. First, the hook 60 may accommodate straps of garments such as lingerie. Further, the hook 60 includes a flat configuration (see FIG. 1) that is accommodated comfortably in the palm of the hand if one were to grab the clamp 18 and pull it outward toward the hook 60 with one's fingers. Thus, a sharp end to the crossbar 14 is not preferred and would preclude the easy outward lateral adjustment provided by the grasping motion illustrated above.

Turning to FIGS. 4, 6 and 7, the effect of the step 32 is illustrated. The relative width of the upper ridge 22 at line 6—6 is illustrated in FIG. 6. The width of the upper ridge 22 illustrated in FIG. 6 enables the clamp 18 to be adjusted laterally with relative ease. However, on an opposing side of the step 32 at line 7—7, the upper ridge is much wider and cannot be accommodated between the C-shaped detents due to the spring-bias of the U-shaped clip 48. Accordingly, the inward lateral movement of the clamps 16 may be limited by widening the upper ridge 22. Another way to limited the inward lateral movement of the clamps 16 is illustrated in FIG. 5. Specifically, ribs such as those shown at 28 may be disposed on opposing sides of the wall 24 of the crossbar 14. As shown in FIG. 3, the ribs 28 extends between the lower ridge 26 and upper ridge 22 or step 32.

Figure 8:
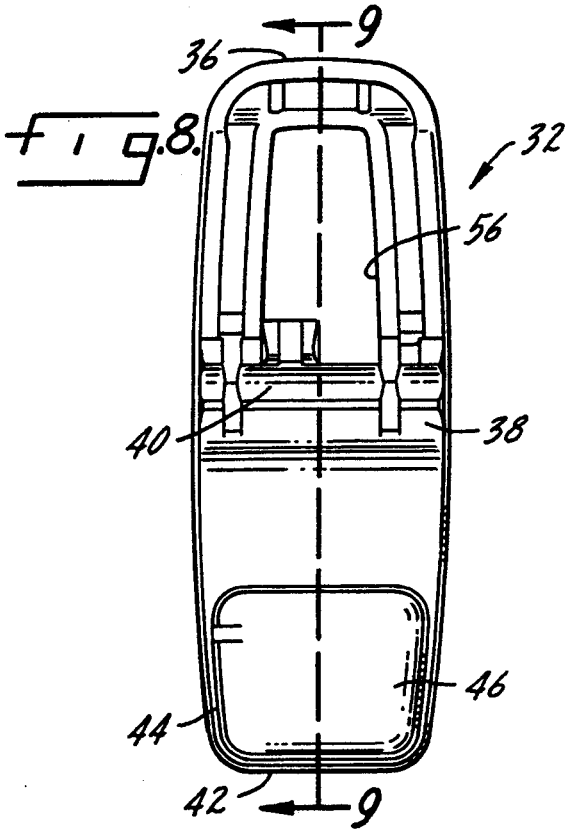
FIG. 8 is an elevational view of a jaw of a clamp made in accordance with the present invention.
Figure 10:
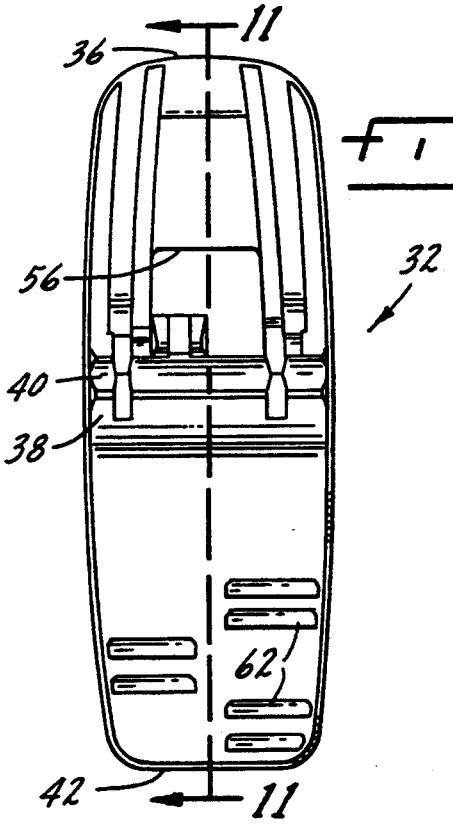
FIG. 10 is an elevational view of a jaw of an alternative clamp made in accordance with the present invention.
Figure 11:
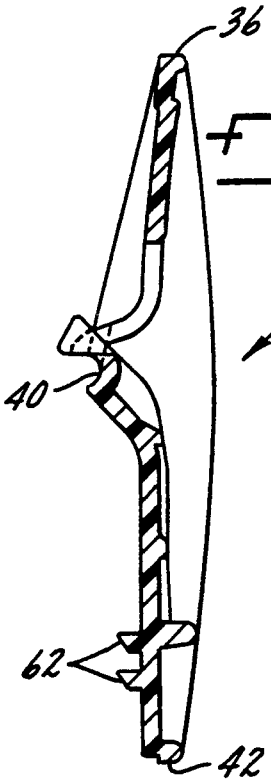
FIG. 11 is a sectional view taken substantially along line 11—11 of FIG. 10.

Turning to FIGS. 8 through 11, two embodiments of a jaw 32 are illustrated. Other configurations of the jaw 32 will be apparent to those skilled in the art. Turning first to FIG. 8, the jaw includes a resilient friction pad 46 accommodated at a lower clamping surface 44 disposed at the lower end 42 of the jaw 32. The detent 40 disposed in the middle portion 38 of the jaw 32 accommodates the upper ridge 22 of the crossbeam 14. The U-shaped clip 48 is inserted through the slot 56, Referring not to FIG. 9, the upper end 36 of the jaw 32 may be reconfigured to provide a more ergonomically designed thumb grip or finger grip. FIGS. 10 and 11 illustrate a jaw 32 with teeth 62 opposed to a resilient pad 46. Still other jaw configurations will be apparent to those skilled in the art.

Thus, an improved plastic clamp-style garment hanger 10 is provided. Preferably, the crossbar 14 is fabricated from plastic and may be provided in a variety of colors or clear plastic. The plastic clamps 16 are also aesthetically designed for the satisfaction of retailers. The frictional engagement between the C-shaped detents 40 and the upper ridge 22 of the crossbar 14 avoids clamp creep yet enables the clamps 16 to be moved relatively easily. The garment hanger 10 illustrated is easy to use and is thereby suitable for home use and further is aesthetically appealing which is required by retail establishments.

Although only two embodiments of the present invention have been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

I claim:

1. A laterally adjustable clamp-type garment hanger comprising:

a hang means;

the hang means connected to a central portion of a crossbar, the crossbar including two ends, the crossbar further including a wall connected to an upper ridge, the upper ridge and the wall connecting the two ends of the crossbar, the upper ridge extending frontward and rearward from the wall;

two garment clamps slidably and pivotally engaging the upper ridge of the crossbar on opposing sides of the hang means, each clamp including a front jaw and a rear jaw, each jaw including a lower clamping surface, an upper end and a central portion disposed therebetween, the lower clamping surface of the front jaw being spring biased toward the lower clamping surface of the rear jaw by a U-shaped clip, the U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end being disposed between the upper ends of the front and rear jaws, the central portion of the front jaw including a plurality of detents for pivotally engaging a front end of the upper ridge of the crossbar, the central portion of the rear jaw including a plurality of detents for pivotally engaging a rear end the upper ridge of the crossbar, the detents of the front and rear jaws of each clamp being capable of sliding laterally along the upper ridge of the crossbar.

2. The garment hanger of claim 1, wherein the lower clamping surfaces of the front and rear jaws include teeth for gripping a garment.

3. The garment hanger of claim 1, wherein the lower clamping surfaces of the front and rear jaws carry at least one resilient pad, a first side of the resilient pad being secured to and carried by the lower clamping surface, a second side of the resilient pad being presented for contact with a garment to be hung from the hanger, the resilient pad being fabricated from resilient friction material.

4. The garment hanger of claim 1, wherein the upper ridge includes means for precluding laterally inward movement of the clamps beyond stop points disposed on opposing sides of the hang means.

5. The garment hanger of claim 4, wherein the means for precluding laterally inward movement of the clamps includes two vertical ribs disposed on opposing sides of the crossbar, the ribs precluding sliding of the clamps inward past the ribs toward the hang means.

6. The garment hanger of claim 4, wherein the means for precluding laterally inward movement of the clamps includes two outwardly protruding steps disposed on the upper ridge on opposing sides of the hang means, the steps precluding sliding of the clamps inward past the steps toward the hang means.

7. The garment hanger of claim 1, wherein the means for precluding laterally inward movement of the clamps includes the upper ridge being tapered outward away from the wall as the upper ridge nears the hang means and the upper ridge is tapered inward toward the wall as the upper ridge nears the ends of the crossbar.

8. The garment hanger of claim 1, wherein the upper ridge includes two outwardly protruding stops, one stop disposed adjacent to each end of the crossbar to preclude the sliding of the clamps off of the crossbar.

9. A laterally adjustable clamp-type garment hanger comprising:

a hang means;

the hang means connected to a central portion of a crossbar, the crossbar including two ends, the crossbar further including an upper ridge for slidably engaging clamps disposed on opposing sides of the hang means, the crossbar further including a wall connected to the upper ridge, the,upper ridge and the wall connecting the two ends of the crossbar, the upper ridge extending frontward and rearward from the wall;

two garment clamps slidably and pivotally engaging said crossbar on opposing sides of the hang means, each clamp including a front jaw and a rear jaw, each jaw including a garment engaging surface, a U-shaped clip for biasing the garment engaging surface of the front jaw toward the garment engaging surface of the rear jaw, the U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end passing through apertures disposed in an upper end of the front jaw and an upper end of the rear jaw, each jaw including a plurality of detents for pivotally engaging the upper ridge of the crossbar, the detents of the front and rear jaws cooperatively permitting the clamp to be slid laterally along the upper ridge of the crossbar, each jaw further includes a central portion, the central portion of each front jaw accommodating the detents for pivotally engaging a front end of the Upper ridge of the crossbar, the central portion of each rear jaw accommodating the detent for pivotally engaging a rear end the upper ridge of the crossbar.

10. The garment hanger of claim 9, wherein the lower clamping surfaces of the front and rear jaws include teeth for gripping a garment.

11. The garment hanger of claim 9, wherein the lower clamping surfaces carry at least one resilient pad, a first side of the resilient pad being secured to and carried by the lower clamping surface, a second side of the resilient pad being presented for contact with a garment to be hung from the hanger, the resilient pad being fabricated from resilient friction material.

12. The garment hanger of claim 9, wherein the upper ridge includes means for precluding laterally inward movement of the clamps beyond stop points disposed on opposing sides of the hang means.

13. The garment hanger of claim 12 wherein the means for precluding laterally inward movement of the clamps includes two vertical ribs disposed on opposing sides of the crossbar, the ribs engaging the detents of the front and rear jaws and precluding sliding of the clamps inward past the ribs toward the hang means.

14. The garment hanger of claim 12 wherein the means for precluding laterally inward movement of the clamps includes two outwardly protruding steps disposed on opposing sides of the hang means, the steps engaging the detents of the jaws and precluding sliding of the clamps inward past the steps toward the hang means.

15. The garment hanger of claim 12, wherein the means for precluding laterally inward movement of the clamps includes the upper ridge being tapered outward away from the wall as the upper ridge nears the hang means and the upper ridge is tapered inward toward the wall as the upper ridge nears the ends of the crossbar.

16. The garment hanger of claim 9, wherein the upper ridge includes two outwardly protruding stops, one stop disposed adjacent to each end of the crossbar to preclude the sliding of a clamp off of the crossbar.

17. A laterally adjustable clamp-type garment hanger comprising:

a hook;

the hook connected to a central portion of a crossbar, the crossbar including two ends, the crossbar further including a wall connected to an upper ridge, the upper ridge and the wall connecting the two ends of the crossbar, the upper ridge extending frontward and rearward from the wall, the upper ridge further including two outwardly protruding stops, one stop disposed adjacent to each end of the crossbar to preclude the sliding of the clamps off of the crossbar, the wall further including two vertical stop ribs, one stop rib disposed on either side of the hook;

two garment clamps slidably connected to and pivotally engaging the upper ridge of the crossbar on opposing sides of the hook, each clamp including a front jaw and a rear jaw, each jaw including a lower clamping surface, an upper end and a central portion disposed therebetween, the lower clamping surface of the front jaw being spring biased toward the lower clamping surface of the rear jaw by a U-shaped clip, the U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end being disposed between the upper ends of the front and rear jaws, the central portion of the front jaw including at least one detent for pivotally engaging a front end of the upper ridge of the crossbar, the central portion of the rear jaw including at least one detent for pivotally engaging a rear end the upper ridge of the crossbar, the detents of the front and rear jaws of each clamp being capable of sliding laterally along the upper ridge of the crossbar.

18. A laterally adjustable clamp-type garment hanger comprising:

a hang means;

a crossbar including two ends and an upper ridge connecting the two ends of the crossbar, the upper ridge protruding outward in frontward and rearward directions;

two garment clamps slidably and pivotally engaging the upper ridge of the crossbar on opposing sides of the hang means, each clamp including a front jaw and a rear jaw, each jaw including a lower clamping surface and an inside central portion, the lower clamping surface of the front jaw being spring biased toward the lower clamping surface of the rear jaw by a U-shaped clip, the inside central portion of the front jaw including at least one detent for pivotally engaging a front end of the upper ridge of the crossbar, the inside central portion of the rear jaw including at least one detent for pivotally engaging a rear end the upper ridge of the crossbar, the upper ridge of the crossbar being disposed between the detent of the front jaw and the detent of the rear jaw, the detents of the front and rear jaws of each clamp being capable of sliding laterally along the upper ridge of the crossbar.

19. The garment hanger of claim 18, wherein the front jaw and the rear jaw of each clamp include a plurality detents for engaging the upper ridge of the crossbar.

20. A laterally adjustable clamp-type garment hanger comprising:

a hook;

the hook connected to a central portion of a crossbar, the crossbar including two ends, the crossbar further including an upper ridge, the upper ridge connecting the two ends of the crossbar, the upper ridge protruding outward in frontward and rearward directions, two garment clamps slidably and pivotally engaging the upper ridge of the crossbar on opposing sides of the hook, each clamp including a front jaw and a rear jaw, each jaw including a lower clamping surface, an upper end and a central portion disposed therebetween, the lower clamping surface of the front jaw being spring biased toward the lower clamping surface of the rear jaw by a U-shaped clip, the central portion of the front jaw including at least one detent for slidably and pivotally engaging a front end of the upper ridge of the crossbar, the central portion of the rear jaw including at least one detent for slidably and pivotally engaging a rear end the upper ridge of the crossbar.

21. The garment hanger of claim 20, wherein the front jaw and the rear jaw of each clamp include a plurality detents for slidably engaging the upper ridge of the crossbar.

* * * * *